US005593627A

United States Patent [19]

Bishara et al.

[11] Patent Number: 5,593,627

[45] Date of Patent: Jan. 14, 1997

[54] ELECTROLYTIC TREATMENT OF AN ELECTROLYTIC SOLUTION

[75] Inventors: Jeries I. Bishara, Mentor; James R. Brannan, Perry; Roland J. Horvath, Lyndhurst; Anthony R. Sacco, Mentor; Jean M. Hinden, Chardon, all of Ohio

[73] Assignee: Eltech Systems Corporation, Chardon, Ohio

[21] Appl. No.: 534,683

[22] Filed: Sep. 27, 1995

Related U.S. Application Data

[62] Division of Ser. No. 401,381, Mar. 9, 1995, Pat. No. 5,474,661, which is a continuation of Ser. No. 67,918, May 27, 1993, Pat. No. 5,405,507, which is a continuation-in-part of Ser. No. 799,653, Nov. 29, 1991, Pat. No. 5,246,559.

[51] Int. Cl.[6] ..... B27J 5/00

[52] U.S. Cl. ..... 264/127; 204/252

[58] Field of Search ..... 264/453, 122, 264/127; 204/252

[56] References Cited

U.S. PATENT DOCUMENTS

| | | | |
|---|---|---|---|
| 3,553,032 | 1/1971 | Baba | 264/109 |
| 4,380,521 | 4/1983 | Moreno | 264/49 |
| 4,606,805 | 8/1986 | Bon | 204/296 |
| 4,853,101 | 8/1989 | Hruska | 204/296 |
| 5,091,252 | 2/1992 | Hruska | 427/357 |
| 5,192,473 | 3/1993 | Hruska | 264/102 |

FOREIGN PATENT DOCUMENTS

86/01841 3/1986 WIPO .

*Primary Examiner*—Bruce F. Bell
*Assistant Examiner*—Brendan Mee
*Attorney, Agent, or Firm*—John J. Freer; David J. Skrabec

[57] ABSTRACT

Methods, and various apparatus therefor, are disclosed for the electrolytic treatment of an acidic solution. Generally the method comprises: (a) providing an electrolytic cell, the cell comprising: (i) an anode chamber and an anode therein; (ii) a cathode chamber and a cathode therein; and (iii) a diaphragm. Usually the diaphragm is of a non-isotropic fibrous mat comprising 5–70 weight percent organic halocarbon polymer fiber in adherent combination with about 30–95 weight percent of finely divided inorganic particulate impacted into said fiber during fiber formation, the diaphragm having a weight per unit of surface area of about 3–12 kilograms per square meter. The method can continue by (b) introducing the acidic solution into the cell; (c) impressing a current on the anode and the cathode causing the migration of ions through the diaphragm; and (d) recovering a product of the electrolytic treatment from the anode chamber, or the cathode chamber, or from both chambers. In one method, the acidic solution is a cell bath circulated to the anode chamber, while rinse solution downstream of the cell bath is circulated to the cathode chamber. The method, and apparatus therefor, are particularly applicable to the recovery of hexavalent chromium from a dilute chromium electroplating rinse solution.

7 Claims, 2 Drawing Sheets

ELECTROLYTIC TREATMENT OF AN ELECTROLYTIC SOLUTION

This is a divisional of application Ser. No. 08/401,381, filed Mar. 9, 1995, (now U.S. Pat. No. 5,474,661) which is a continuation of U.S. patent application Ser. No. 08/067,918, filed May 27, 1993 (now U.S. Pat. No. 5,405,507), which in turn is a continuation-in-part of U.S. patent application Ser. No. 07/799,653, filed Nov. 29, 1991 (now U.S. Pat. No. 5,246,559).

BACKGROUND OF THE INVENTION

1. Technical Field

The present invention, in one respect, relates to the electrolytic treatment of an acid solution, for instance the recovery of metals from an acid solution. One example of this aspect of the present invention is the preparation of a more concentrated solution containing hexavalent chromium from a dilute electroplating rinse solution containing hexavalent chromium. The present invention, in another respect, relates to the electrolytic treatment of an acid bath such as an electroplating bath or anodizing bath for the purpose of rejuvenating the bath. This treatment is in combination with treatment of an acid solution, wherein the acid solution is a rinse solution for the acid bath.

2. Description of the Prior Art

In the electroplating of a workpiece in a chromic acid solution, the electroplating cell is generally followed by one or more rinse tanks in which the plated workpiece is rinsed. It is desirable to maintain a low concentration of chromium ions in the rinse water. Accordingly, where more than one rinse tank is used, fresh water can be introduced into the last rinse tank, and cascaded from the last rinse tank to the penultimate rinse tank, on up to the rinse tank closest to the electroplating cell. The rinse tank closest to the electroplating cell experiences a build-up of chromium ions in the tank. The rinse solution in this rinse tank has too high a concentration of chromium ions for sewer disposal of the solution. In addition, it is economically desirable to recover the chromium ions if possible.

U.S. Pat. No. 4,302,304 discloses a process for treating a chromic acid-containing metal plating waste water. The metal plating waste water is fed to the cathode chamber of an electrolytic cell. The cell is partitioned with a diaphragm. A DC voltage is applied between the cell anode and the cathode which impresses a current across these electrodes. This causes the migration of chromate or dichromate ions to the anode chamber. Chromic acid is recovered in the anode chamber of the cell, and reusable water is recovered in the cathode chamber of the cell. The diaphragm may be made of glass fiber, porcelain, cloth, or of porous high molecular weight polymers. The chromic acid withdrawn from the anode chamber is sufficiently concentrated that it can also be reused.

U.S. Pat. No. 3,481,851 discloses reconditioning a chromic acid containing metal solution such as a used chrome plating solution. The used solution is introduced as anolyte into an anode compartment of an electrodialysis cell. The cell has a cation permeable membrane dividing the anode compartment from a cathode compartment in the cell. When the cell is energized, dissolved foreign ions in the used solution, such as copper, iron, zinc, nickel and cadmium, selectively pass through the membrane to the cathode compartment, and simultaneously, oxygen evolved at the anode oxidizes trivalent chromium to hexavalent chromium. The catholyte is an acid solution such as one containing 10% by volume of hydrochloric acid.

Similar disclosures are contained in U.S. Pat. Nos. 3,764,503, 4,006,067, 4,243,501, 4,337,129, and 4,857,162.

U.S. Pat. No. 3,948,738 discloses, in one embodiment, introducing a diluted exhausted chromium plating solution into an anode compartment of a two-compartment cell. A more concentrated exhausted chromium plating solution is introduced into the cathode compartment. On energizing the cell, chromic acid values transfer to the anolyte. The cell is deenergized, and the anolyte is withdrawn for use in the chromium plating bath. The catholyte is transferred to the anode compartment and electrolysis is resumed. The purpose of dilution of the anolyte is to maintain a low concentration of iron in the chromium plating bath.

SUMMARY OF THE INVENTION

The present invention, in one respect, resides broadly in an electrolytic cell for recovering product from an electrolyte solution containing metal in solution, which method includes the electrolysis of an acidic solution, or the recovery of metal, or both. The cell comprises an anode chamber and an anode therein, a cathode chamber and a cathode therein, and a diaphragm of a non-isotropic compressed fibrous man comprising 5–70 weight percent organic halocarbon polymer fiber in adherent combination with about 30–95 weight percent of finely divided inorganic particulate impacted into said fiber during fiber formation. The diaphragm has a weight per unit surface area of about 3–12 kilograms per square meter, and a permeability of less than 0.03 $mm^{-1}Hg$ at two liters per minute air flow through a 30 inch square area of the diaphragm. The cell comprises means for recovering said product from the anode chamber, the cathode chamber, or from both chambers.

Preferably, the diaphragm has a permeability of less than 0.015 $mm^{-1}Hg$ at two liters per minute air flow through a 30 square inch area of the diaphragm.

The present invention also resides in a method for the electrolytic recovery of product from an acidic solution containing metal in solution comprising the steps of (a) providing an electrolytic cell, said cell comprising an anode chamber and an anode therein, a cathode chamber and a cathode therein, and a diaphragm of a compressed fibrous mat comprising 5–70 weight percent organic halocarbon polymer fiber in adherent combination with about 30–95 weight percent of finely divided inorganic particulates, said diaphragm having a weight per unit of surface area of about 3–12 kilograms per square meter; (b) introducing said acidic solution into said cell; (c) impressing a current across said anode and said cathode causing the migration of ions through said diaphragm; and (d) recovering said product from said anode chamber, from said cathode chamber, or from both chambers.

Preferably, the diaphragm has a permeability of less than 0.03 $mm^{-1}Hg$ at two liters per minute air flow through a 30 inch square area of the diaphragm, more preferably in the range of 0.015–0.01 $mm^{-1}Hg$ at two liters per minute air flow through a 30 square inch area of the diaphragm.

An embodiment of the present invention resides in a chromium electroplating apparatus which comprises an electroplating cell, and at least one rinse tank for said electroplating cell. The rinse tank contains a relatively dilute solution of chromic acid. An electrolytic cell is also provided. The electrolytic cell comprises an anode chamber and an anode therein, a cathode chamber and a cathode therein, and a diaphragm separating the cathode chamber from the anode chamber. Means are provided communicating the rinse tank with the electrolytic cell cathode chamber. The diaphragm comprises a compressed fibrous mat comprising 5–70 weight percent organic halocarbon polymer fiber in adherent combination with about 30–95 weight percent of finely divided inorganic particulate. The diaphragm has a weight per unit surface area of about 3–12 kilograms per square meter, and a permeability of less than 0.03 $mm^{-1}Hg$ at two liters per minute air flow through a 30 square inch area of the diaphragm.

The present invention also resides in a method for recovering chromic acid from a chromium electroplating rinse solution which comprises providing said chromium electroplating apparatus; introducing a rinse solution into the cathode chamber of the electrolytic cell; impressing a current across said anode and said cathode causing the migration of chromate ions from said cathode chamber to said anode chamber; and recovering a more concentrated solution of chromic acid from said anode chamber for reuse in the plating process.

The present invention, in another respect, resides in a method, and apparatus therefor, for the simultaneous recovery of acid anions from a rinse solution of an acid bath, such as a chromium electroplating bath or an anodizing bath, and simultaneously rejuvenating the acid bath by the removal of metal cations from said bath. The method comprises providing an electrolytic cell which comprises (i) an anode chamber and an anode therein; (ii) a cathode chamber and a cathode therein; and (iii) a diaphragm separator between said anode and cathode chambers. A rinse solution of said acid bath is circulated through the cathode chamber. The rinse solution contains acid anions from said acid bath. The acid bath is circulated through the anode chamber. The acid bath contains metal cations. A current is impressed upon said cell as by applying a DC voltage between the anode and the cathode. The impressed current causes (i) the migration of the acid anions from said cathode chamber to said anode chamber; and (ii) the migration of metal cations from said anode chamber to said cathode chamber. Preferably, the pH of the rinse solution is maintained at that pH effective for the precipitation of the metal cations as metal hydroxides in the rinse solution. The metal hydroxides are then filtered from the rinse solution and the rinse solution is recycled for reuse. The rejuvenated acid bath, is recycled from the anode chamber for reuse.

A preferred pH of the rinse solution is in the range of 2–7.

In an embodiment of the present invention, the acid bath is a chrome plating bath. The acid anions are chromate ions. The acid bath contains trivalent chromium ions as well as chromate ions. The impressed electrical current causes, in addition to the migration of ions through said separator, the oxidation in the anode chamber, of the trivalent chromium ions to chromate ions.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Although reference hereinafter, as well as hereinabove, is frequently made to chromic acid recovery, it will be understood that such reference is an embodiment of the invention, which embodiment is used for convenience. Thus it is to be understood that the processes and apparatus of the invention are contemplated for use beyond a chromic acid recovery process, as will be understood by those skilled in the art. When referring to chromic acid recovery, reference herein may be made to recovery of chromate ions, which may also be termed herein as "chromic acid anions". Generally when the chromium in solution is in the hexavalent state, it is stated as such or shown as $Cr^{+6}$ or chromium(VI). Likewise, for chromium in the trivalent state, reference is so made herein or by the designation $Cr^{+3}$ or chromium(III). Chromic acid may be termed herein as the "hydrate of $CrO_3$", or for convenience referred to simply as "$CrO_3$".

Figure 1:
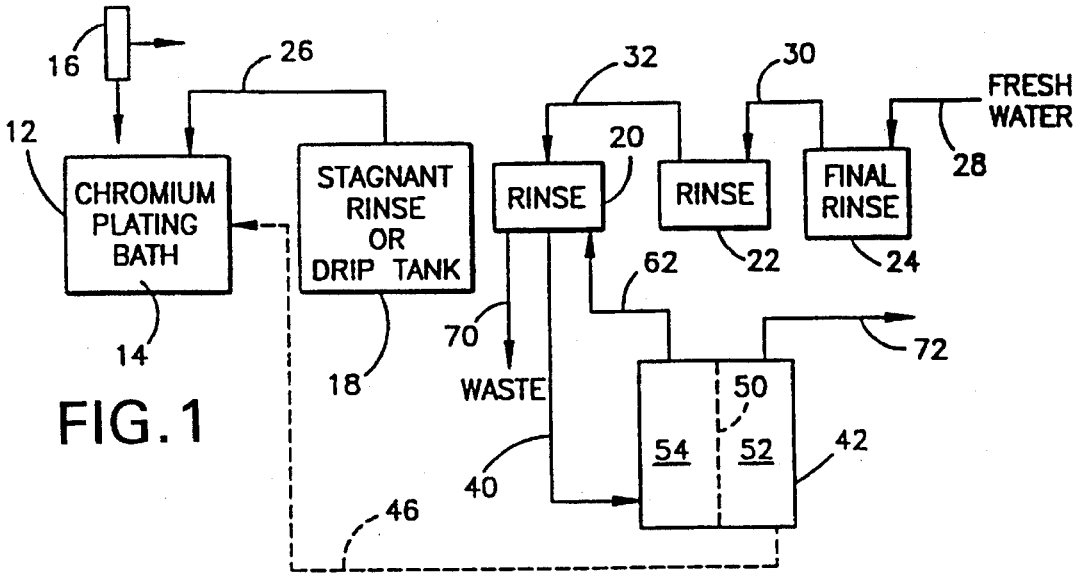
FIG. 1 is a schematic flow diagram of a chromium plating process and chromic acid recovery system in accordance with an embodiment of the present invention.

Referring to FIG. 1, an electroplating cell 12 contains a chromic acid plating bath 14. A part 16 is dipped into the bath 14, and held in the bath 14 for a sufficient period of time to be plated. After plating, the part 16 is moved to or above a stagnant tank 18. It is either held above the tank 18, in which instance the tank 18 functions as a stagnant drip tank, or it is dipped into the tank 18, in which instance the tank 18 functions as a stagnant rinse tank. Usually, the tank 18 will be referred to herein for convenience as a rinse tank. From the tank 18, the part 16 is then transported to one or more rinse tanks. In the embodiment of FIG. 1, three rinse tanks are shown, a first rinse tank 20, a second rinse tank 22, and a third rinse tank 24.

The stagnant rinse or drip tank 18 has a solution in it which may be moderately concentrated in chromate ions from solution which is carried over from the plating bath 14 by multiple parts 16. Line 26 returns the solution in tank 18 to the electroplating cell 12, as make-up for the plating bath 14. This can be carried out on a continuous basis, or periodically, for instance once a day. If necessary, the stagnant rinse or drip tank 18 can be replenished with solution drawn from the first rinse tank 20.

As the part 16 is moved from the stagnant rinse or drip tank 18 to the first rinse tank 20, and then to the second rinse tank 22 and third rinse tank 24, chromic acid is rinsed from the part 16. Most of the chromic acid is removed from the part 16 in the first rinse tank 20, with lesser amounts being removed in the second and third rinse tanks 22 and 24. Thus, the rinse tank with the highest concentration of chromate ions becomes the first rinse tank 20.

To compensate for evaporation and other losses in the rinse tanks 20, 22 and 24, fresh water is introduced into the third rinse tank 24, in line 28. The rinse solution in the third rinse tank 24 is then cascaded in line 30 to the second rinse tank 22, and from there, in line 32, to the first rinse tank 20, all at essentially the same rate at which fresh water is added to the final rinse tank 24, in line 28. In this way, the chromic acid in the rinse tanks 20, 22 and 24 is continuously diluted.

Those skilled in the art will recognize that different electroplating operations can be assembled in a large number of different ways, and that the above usage of rinse tanks and/or a drip tank 18 is disclosed herein by way of example only.

Figure 2:
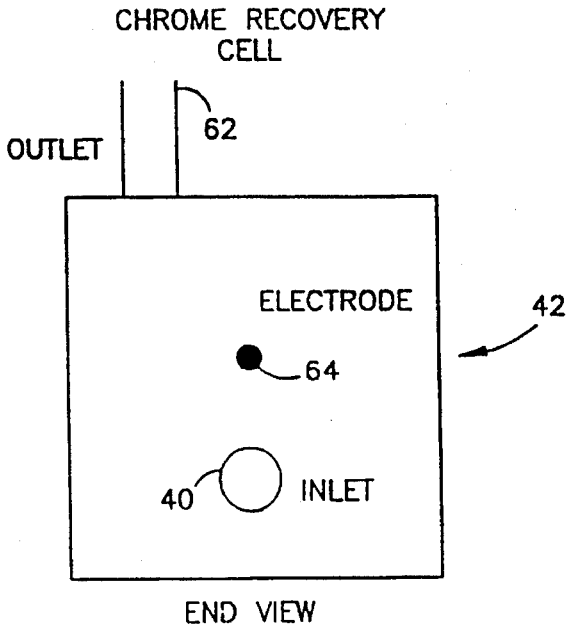
FIG. 2 is a schematic elevation, end view of an electrolytic cell of the recovery system of FIG. 1.
Figure 3:
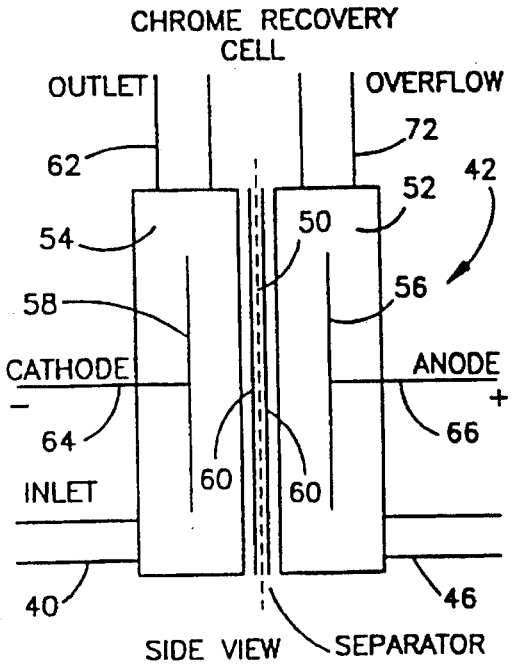
FIG. 3 is a schematic elevation, section, side view of the electrolytic cell of FIG. 2.

In accordance with the present invention, an electrolytic cell 42 is connected, by line 40, with the first rinse tank 20. The electrolytic cell is shown in FIGS. 2 and 3. The electrolytic cell is partitioned by a diaphragm 50 (FIG. 3) into a cathode chamber 54 and an anode chamber 52. The diaphragm 50 may sometimes be referred to herein as a "separator". Only one anode chamber 52 and one cathode chamber 54 are shown in FIG. 3. In a commercial apparatus, the electrolytic cell 42 may comprise multiple anode chambers 52 and multiple cathode chambers 54, separated by multiple diaphragms 50. Also, for purposes of illustration, the electrolytic cell 42 is shown in FIG. 3 with parts separated from one another. During use, the cathode chamber 54 and anode chamber 52 are positioned contiguous with each other separated by diaphragm 50 and gaskets 60, which seal the chambers 52, 54. The anode chamber 52 contains an anode 56, and the cathode chamber 54 contains a cathode 58. Line 40 (FIGS. 1 and 3) connects the first rinse tank 20 with the cathode chamber 54, as shown in FIGS. 1 and 3. A return line 62, FIGS. 1, 2 and 3, leads from the cathode chamber 54 back to the rinse tank 20. As an alternative, the return line 62 could lead back to the final rinse tank 24, or to the second rinse tank 22.

The description of the FIGS. 4 and 5 will be more particularly presented hereinbelow in connection with the examples.

Referring then back to FIGS. 1, 2 and 3, in operation the metal plating rinse solution, from the rinse tank 20 (FIG. 1) flows in line 40 to the cathode chamber 54 (FIG. 3) of the electrolytic cell 42. The flow in line 40 is a relatively concentrated solution containing chromate ions. A voltage is impressed on the cathode and anode of the electrolytic cell 42 through suitable electrode connectors 64, 66. (FIGS. 2 and 3). FIG. 2 shows the location of connector 64 for cathode 58. FIG. 2 also shows lines 40 and 62. Under the influence of the impressed voltage on the anode and the cathode, chromate ions pass through the diaphragm 50 (FIG. 3) from the cathode chamber 54 to the anode chamber 52. Thus, return line 62 returns a solution to the rinse tank 20 (or to the rinse tanks 22 or 24 if desired) which has a relatively low concentration of chromate ions therein.

It will be apparent to those skilled in the art that some $Cr^{+3}$ and other metal ions may plate at the cathode 58. Most of the $Cr^{+3}$ and metal ions in the catholyte will precipitate from the solution and be filtered from the solution in a clarifier (not shown) prior to return of the solution to rinse tank 20, in a manner well known in the art.

The electrolytic cell 42 has an outlet line 46, shown as a dashed line in FIG. 1, between the anode chamber 52 of the electrolytic cell 42 and the electroplating cell 12. Operation of the electrolytic cell 42 results in the concentration of chromate ions in the anolyte of the cell, in anode chamber 52. This produces a solution in the anode chamber 52 which has a relatively high concentration of chromate ions. This relatively concentrated solution is returned in line 46 to the electroplating cell 12. Preferably, the concentrated solution is withdrawn from the electrolytic cell 42, on a periodic basis, to a receiving vessel (not shown) and then withdrawn from the receiving vessel, as needed, to the electroplating cell 12. The use of a dashed line means that the flow of anolyte back to the electroplating cell may be other than direct.

Periodically, a portion of the rinse solution in rinse tank 20 may be withdrawn in line 70, FIG. 1, for waste treatment. The purpose of line 70 is to purge from the rinse solution in vessel 20 contaminants which may build up in the rinse solution over a period of time.

It can be seen from the above that the electrolytic cell 42 accomplishes a plurality of objectives. Primarily, it accomplishes a recovery of chromate ions from the rinse solution which can be recycled to the plating bath 14. It may also remove $Cr^{+3}$ and metal impurities. In addition, the electrolytic cell 42, by providing a means for recovering the chromium, reduces or eliminates the amount of waste that has to be withdrawn in line 70 and subjected to waste treatment. This also reduces the amount of fresh rinse water that has to be added to the rinse tank 24 in line 28.

The separator 50, in the present invention, is a diaphragm. Being a diaphragm, it is possible for water, hereinafter referred to as transport water, to flow from the cathode chamber 54 to the anode chamber 52, along with the chromate ions. Line 72, FIG. 3, provides an overflow to accommodate the transport water. However, it is desirable to reduce the flow of transport water into the anode chamber, since an objective in operation of the electrolytic cell 42 is to obtain as concentrated a solution as possible of chromate ions in the anolyte.

In some aspects of the invention a fibrous mat diaphragm must be used, while in other aspects of the invention it is acceptable to use an ion permeable separator which can include use of such fibrous mat diaphragm, the choice being most particularly detailed hereinafter in the appended claims. Where the separator 50 is to be a diaphragm fibrous mat, it is preferably a diaphragm as disclosed in U.S. Pat. No. 4,853,101, the disclosure of which is incorporated herein by reference. It is disclosed in the patent that the diaphragms are useful in a chlor-alkali cell. It is advantageously a "dimensionally stable" diaphragm, which is meant that the diaphragm 50 is resistant to corrosion or swelling from the environment of the solutions within the cell 42. The diaphragm comprises a fibrous mat wherein the fibers of the mat comprise 5–70 weight percent organic halocarbon polymer comprising polymer in fiber form in adherent combination with about 30–95 weight percent of finely divided inorganic particulates in adherent combination with the halocarbon polymer. The diaphragm has a weight per unit of surface area of between about 3 to about 12 kilograms per square meter. Preferably, the diaphragm has a weight in the range of about 3–7 kilograms per square meter.

The inorganic particulates are refractory in the sense that they will retain particulate form in use in the diaphragm. The particulates are also inert to the polymer fiber substrate and to the environment of the solutions within the cell 42. By being inert, they are capable of being physically bound to the polymer in processing, without chemically reacting with the polymer, and they are not corroded by the solutions within the cell 42. A particularly preferred particulate is zirconia. Other metals and metal oxides, i.e., titania, can be used, as well as metal alloys, silicates such as magnesium silicate and aluminosilicate, aluminares, ceramics, cermets, carbon, and mixtures thereof.

The particulates preferably have a particle size of less than about 100 mesh (about 150 microns), more preferably smaller than about 400 mesh (36 microns). Preferably, the particulates have an average particle size greater than 1 micron, for ease of manufacture. Sub-micron particles can become substantially or virtually completely encapsulated in the polymer substrate.

In the case of zirconia, the particulate preferably has an average particle size in the range from about 1 to about 16 microns, more preferably an average particle size in the range from about 5 to about 12 microns.

The polymer of the diaphragm utilized in the present invention can be any polymer, copolymer, graft polymer or combination thereof which is chemically resistant to the chemicals within the electrolytic cell 42. A preferred polymer is a halogen-containing polymer which includes fluorine, such as polyvinyl fluoride, polyvinylidene fluoride, polytetrafluoroethylene polymer, polyperfluoroethylene propylene, polyfluoroalkoxyethylene, polychlorotrifluoroethylene, and the copolymer of chlorotrifluoroethylene and ethylene. Preferred polymers are polytetrafluoroethylene (PTFE) fluorocarbon polymers marketed by E.I. DuPont de Nemours & Co. under the trademark "TEFLON".

The inorganic particulates are firmly adhered with the polymer. For the preferred diaphragm such binding can occur at the same time as the forming and growing of polymer fibers, as taught in the U.S. Pat. Nos. 4,853,101, 5,091,252 and 5,192,473. For other useful diaphragms, some binding can take place during diaphragm heating. These other diaphragms contemplated for use have been more particularly disclosed in U.S. Pat. No. 4,606,805. Diaphragm heating will be more particularly discussed hereinbelow. Also, for still other useful diaphragms, as disclosed in U.S. Pat. Nos. 5,188,712 and 5,192,401, some binding may be occasioned by impregnation of polymer fibers. Some of the particulates may become encapsulated in the polymer fibers, while some are not fully encapsulated, and thus impart an inorganic, particulate character to the fiber surface. The specific character achieved is dependent upon the diaphragm formation characteristics.

Usually, a slurry of the diaphragm-forming ingredients is prepared and deposited on a foraminous substrate, for instance in a conventional paper-making procedure. The slurry may be drawn onto the foraminous substrate by use of a vacuum on one side of the substrate. The deposit on the substrate may then be removed and dried. The diaphragms are then heated. For the preferred diaphragms this can be for a time sufficient to produce a composite structure in which the fibers are fused together. The heating should be for a time and temperature insufficient to cause any decomposition of the polymeric material. By way of example, a diaphragm using a polytetrafluoroethylene polymer, requires a fusion temperature of about 300° C. to about 390° C. Usually the heating is carried out for about 0.25–3 hours, more preferably for about 0.25–1.5 hours.

The diaphragms advantageously have a permeability of less than about 0.03 $mm^{-1}Hg$ at two liters per minute air flow through a 30 inch square area, more preferably a permeability within the range of about 0.015–0.01 $mm^{-1}$ Hg at two liters per minute air flow through a 30 square inch area. The permeability is determined by measuring the pressure required to pass air through a sheet of the material. A test apparatus is provided comprising a steel frame with a square 30 square inch opening into which has been welded a steel mesh support. The diaphragm, approximately six inches by six inches in size, is placed on the steel mesh, overlapping the steel frame. A gasket with a 30 square inch opening is placed on the diaphragm, and a steel top is bolted to the frame to seal the diaphragm in place. The top has two connectors, one connected to an air line and a flow meter, the other to a mercury (Hg) manometer. Typically, the permeability is measured with an air flow of two liters per minute through a 30 square inch piece of diaphragm and is recorded as $mm^{-1}Hg$ at two liters per minute air flow rate.

It may be necessary to compress the diaphragm to achieve the desired permeability. Compression can also assist in providing firmly adherent particulates to the polymer of the diaphragm. For instance, a commercially available diaphragm, marketed by the assignee of the present application under the trademark "ELRAMIX", having a weight per unit of surface area of three kilograms per square meter required a compression of about two tons per square inch to achieve a permeability less than about 0.03, and a pressure of about 3.2 tons per square inch to achieve a permeability less than about 0.015. A commercially available "ELRAMIX" diaphragm having a weight per unit of surface area of about 3.4 kilograms per square meter compressed at one ton per square inch had a permeability of about 0.025, but required a compression of about three tons per square inch to achieve a permeability less than about 0.015. Diaphragms having a weight per unit of surface area of about 4.6 and 6.1 kilograms per square meter had permeabilities less than about 0.015 when compressed at one ton per square inch.

In general, the diaphragm compression may be within the range of from about one ton per square inch up to about six tons per square inch, or more, e.g., seven to ten tons per square inch. However, such is more typically from about one to less than five tons per square inch. It is to be understood that by hot pressing, the diaphragm can be serviceably compressed while accomplishing some to all of the above-discussed diaphragm heating.

Preferably, the diaphragms of the present invention are treated with a surfactant prior to use. The treatment can be carried out in accordance with the procedure set forth in the U.S. Pat. No. 4,606,805, or in accordance with the procedure set forth in the Lazarz et al. U.S. Pat. No. 4,252,878. The disclosures of both U.S. Pat. Nos. 4,606,805 and 4,252,878 are incorporated herein by reference.

A preferred surfactant is a fluorinated surface-active agent such as disclosed in U.S. Pat. No. 4,252,878. A preferred fluorinated surface-active agent is a perfluorinated hydrocarbon marketed under the trademark "ZONYL" by E.I. Dupont de Nemours & Co. One suitable perfluorinated hydrocarbon is a non-ionic fluorosurfactant having perfluorinated hydrocarbon chains in its structure and the general formula $F_2C\ (CF_2)_mCH_2O(CH_2CH_2O)_nH$, wherein m is from 5 to 9 and n is about 11. This fluorosurfactant is available under the trademark "ZONYL FSN". This fluorosurfactant is usually supplied in liquid form at a concentration of about 20 to 50 percent solids in isopropanol or an isopropanol water solution. Prior to use, the solution is preferably diluted with water, for instance to a concentration of about 4% V/V. The separator is then immersed in the surfactant solution and allowed to soak for a prolonged period of time, for instance about eight hours. Alternatively, the separator can be immersed under vacuum and soaked for a lesser period of time, for instance about one hour. After soaking, the separator is then dried at about 75°–80° C. for up to about eight hours, and then is ready for use.

The following Examples illustrate the present invention and advantages thereof. Examples 1–3 relate to the recovery of hexavalent chromium from a chrome plating rinse bath. These examples demonstrate the electrolysis of an acidic solution. In this specific electrolysis, product recovery is focused to the concentration of acidic anions, e.g., chromate ions (also termed herein as "chromic acid anions").

Examples 4–8 are comparative Examples illustrating the use of separators, which are not fibrous mat diaphragms, in applications where a fibrous mat diaphragm must be used. They do however disclose ion permeable separators which may be useful in the aspect of the invention as more particularly described in Example 11. Examples 9 and 10 relate to the recovery of metals other than chromium from acid baths. These examples demonstrate the invention method wherein product recovery can include metal electroplating, i.e., recovery of metal as elemental metal. Thus, it is to be understood that product recovery can be product concentration plus metal recovery (Examples 9 and 10). Example 9 further demonstrates metal recovery at alkaline pH, i.e., the concentrated, nickel-containing catholyte has a final pH of 11.1. This example 9 also shows the use of an expanded metal, or reticulated, electrode, i.e., the reticulated nickel cathode of the example, which electrodes are meant to include foam metal electrodes or the like as are used in metal recovery. Example 11 relates to the invention aspect pertaining to the simultaneous recovery of acid anions combined with rejuvenation of a plating bath. A specific description for FIG. 5 follows example 11.

As will be seen by reference to these examples, the pH of a useful electrolyte can readily vary from the catholyte rinse of pH 1.7 in example 11 to the pH of 11.1 for the example 9 final catholyte. In product recovery, the invention is thus generally useful for electrolytes having pH within the range of from about 1, or even less, to about 12 or more. Where the recovery deals with electrolysis of an acid solution, such will be at a pH of below 7. As shown in the examples, product can be recovered from such diverse electrolytic solutions containing metal in solution as chrome plating rinse water, spent electroless nickel plating baths and sulfuric acid/nitric acid etch baths, as well as chromic acid plating bath solution.

EXAMPLE 1

An "ELRAMIX" (trademark) separator, having a base weight per unit of surface area of 4.2 kilograms per square meter, was pressed at five tons per inch square, and had a permeability of about 0.01. The polymer fibers were Polytetrafluoroethylene. The inorganic particulate was zirconia. The separator comprised 70% zirconia and 30% polytetrafluoroethylene. The separator was fit into a test cell, such as cell 42 disclosed in FIGS. 2 and 3. FIG. 3 shows that the cathode and anode chambers 54, 52 were separable from each other. The purpose of this was to provide a cell into which different separators 50 could be inserted to test the separators. The test cell 42 had an active separator area of three inches by four inches. The cell 42 had an anode 56 which was a titanium substrate coated with a precious metal oxide, and thus was dimensionally stable. The cathode 58 was a copper mesh. The anode and cathode chambers (52, 54) were filled with a chrome plating rinse water containing 168 milligrams per liter chromium (VI) and the solution was pumped through the cathode chamber at 100 milliliters per minute. The capacity of the cathode chamber was 225 milliliters and the capacity of the anode chamber was 225 milliliters. No additions were made to the anode chamber after the chamber was filled. The cell was attached to a rectifier which was set at 50 volts. The initial current was three amps and this decreased to two amps at which amperage the current stabilized. The following Table 1 gives the data that was obtained.

TABLE 1

| Hours On Line | Amps | Catholyte Chromate Ion Concentration Initial (mg/l) | Final (mg/l) | Percent SPR |
|---|---|---|---|---|
| 0 | 3 | 168 | 168 | — |
| 8.5 | 2 | 168 | 94.5 | 44 |
| 25 | 2 | 168 | 63.5 | 62 |

The term "Initial", in Table 1, and other Tables herein, means the concentration of the chromate ions in the solution at the inlet 40 of the cathode chamber 54. The term "Final" means the concentration of the chromate ions in the solution at the outlet 62 of the cathode chamber 54. The term "Percent SPR" means percent recovery of chromate ions in a single pass through the cathode chamber. The percent is obtained by subtracting from 100 the quotient of the outlet concentration divided by the inlet concentration.

The separator 50 had a stable performance over the 25 hour duration of the test and the cell had a high, average, single pass recovery of approximately 50%. The cell experienced a very low water transport from the cathode chamber to the anode chamber through the diaphragm, less than about 0.2% based on the catholyte volume per pass.

EXAMPLE 2

The test of Example 1 was repeated using the "ELRAMIX" separator of Example 1 having a weight per unit of surface area of 4.2 kilograms per square meter pressed at three tons per inch square. This gave the separator a permeability of about 0.013. The apparatus and procedure were the same as in Example 1. The following data was obtained.

TABLE 2

| Hours On Line | Amps | Catholyte Chromate Ion Concentration Initial (mg/l) | Final (mg/l) | Percent SPR |
|---|---|---|---|---|
| 0 | 3 | 168 | — | — |
| 0.5 | 2 | 168 | 99 | 41 |
| 7 | 2.5 | 168 | 89 | 47 |

The test was terminated at 7 hours as the separator showed no signs of deterioration, and it was expected that good results would continue to be obtained, as in the test of Example 1. As in Example 1, the cell experienced a very low water transport from the cathode chamber to the anode chamber through the diaphragm, less than about 0.8% based on the catholyte volume per pass.

EXAMPLE 3

The test of Example 1 was repeated using an "ELRAMIX" separator having a weight per unit of surface area of about 5.25 kilograms per square meter. The materials of the separator were the same as in Example 1. The separator was pressed at 6.5 tons per square inch and had a permeability of less than 0.015 $mm^{-1}Hg$. The separator was wetted with a 4% V/V solution of "ZONYL FSN". The separator was fitted into a test cell, such as cell 42, which was then operated as in Example 1. The separator had an active area of three inches by four inches. The following data was obtained.

TABLE 3

| Hours On Line | Amps | Catholyte Chromate Ion Concentration Initial (mg/l) | Final (mg/l) | Percent SPR |
|---|---|---|---|---|
| 0 | 3.0 | 192 | 192 | — |
| .5 | 3.2 | 192 | 42 | 78.1 |
| 2.0 | 3.5 | 192 | 28 | 85.4 |
| 5.0 | 3.5 | 192 | 32 | 83.3 |

It can be seen from the above data that the cell had a very high single pass recovery (Percent "SPR") averaging above about 80. The cell experienced a very low water transport from the cathode chamber to the anode chamber, about 0.3% based on the catholyte volume per pass.

EXAMPLE 4 (COMPARATIVE)

A test was conducted as in Example 1, but using an "AMV SELEMION" (trademark Asahi Glass) anion exchange membrane as a separator, and thus not being representative of the present invention. This separator is marketed as one exhibiting excellent durability when exposed to a broad variety of chemicals. The test was conducted in the same manner as in Example 1 but with an initial anolyte concentration of one gram per liter chromic acid and an initial cell voltage of 40 volts. The following data was obtained.

TABLE 4

| Hours On Line | Amps | Catholyte Chromate Ion Concentration Initial (mg/l) | Final (mg/l) | Percent SPR |
|---|---|---|---|---|
| 0 | 7 | 200 | — | — |
| 2 | 7 | 200 | 16 | 92 |
| 7 | 7 | 200 | 24 | 88 |
| 12 | — | — | — | — |

The "AMV" membrane had a lower electrical resistance than the "ELRAMIX" separator and it operated at a lower cell voltage with a higher current. The recovery efficiency was thus higher than observed with "ELRAMIX". However, the membrane only operated for 12 hours before chemical attack caused it to rupture and the test was terminated.

EXAMPLE 5 (COMPARATIVE)

The test of Example 4 was repeated using a "TOSFLEX" (trademark, Tosoh Corporation) fluorinated anionic membrane, IE-SA485. This membrane is said to be resistant to strong acids, and suitable for such applications as ion exchange, conversion of the valence of a metal ion, and recovery of acids. The same 200 milligrams per liter chromium (VI) solution was used for both the anolyte and catholyte chambers and the cell voltage was 50 volts. The following data was obtained.

TABLE 5

| Hours On Line | Amps | Catholyte Chromate Ion Concentration Initial (mg/l) | Final (mg/l) | Percent SPR |
|---|---|---|---|---|
| 0 | 1.5 | 200 | — | — |
| 1 | 1.5 | 200 | 45 | 77 |
| 2.5 | 0.1 | 200 | 176 | 12 |
| 3.5 | <0.1 | 200 | 182 | 9 |

The chromic acid in the solution quickly attacked the membrane, destroyed the ion exchange groups, and made the separator non-conductive.

EXAMPLE 6 (COMPARATIVE)

A "POREX" (trademark, Porex Technologies) separator made of porous polyvinylidene fluoride (fine pore) was wetted out using the "ZONYL FSN" (trademark) surfactant and was installed in the test cell of Example 5. Both the anolyte and the catholyte were the same solution as in Example 5. The cell voltage was 50 volts. The following data was obtained.

TABLE 6

| Hours On Line | Amps | Catholyte Chromate Ion Concentration Initial (mg/l) | Final (mg/l) | Percent SPR |
|---|---|---|---|---|
| 0 | 3 | 165 | — | — |
| 1 | 3.5 | 165 | 86 | 48 |
| 3.5 | 5.5 | 165 | 144 | 13 |
| 6 | 5.5 | 165 | 136 | 18 |

While the initial recovery was comparable to that achieved with the "ELRAMIX" separators of Examples 1–3, the recovery deteriorated rapidly and stabilized at a very low rate of recovery.

EXAMPLE 7 (COMPARATIVE)

The separator used in this test was a ceramic porous plate with the material designation P1/2B–C, marketed by Coors Ceramicon Designs, Ltd., Golden, Colo. The piece was cut to six inches by six inches, and had a thickness of about 6 millimeters. The piece had an apparent porosity of 38.5% and a pore diameter of less than 0.5 micron. The piece was fitted to the cell. The anolyte and catholyte were again the same solution but differed in concentration from the solutions in the above tests of Examples 1–6. The cell voltage was 50 volts. The following data was obtained.

TABLE 7

| Hours On Line | Amps | Catholyte Chromate Ion Concentration Initial (mg/l) | Final (mg/l) | Percent SPR |
|---|---|---|---|---|
| 0 | 1.5 | 260 | — | — |
| 2 | 5 | 260 | 260 | 0 |
| 4 | 5 | 260 | 220 | 15 |

This material had a very low recovery rate and the test was terminated after four hours.

EXAMPLE 8 (COMPARATIVE)

A ceramic material, sold by Hard Chrome Consultants of Cleveland, Ohio was used in the electrolytic cell of Example 1. This ceramic material typically is used for such applications as electrolytic purification of chromium plating baths. A piece of the ceramic was cut, as with the Coors material, and installed into the test cell. The piece of ceramic material was also 0.25 inch thick. The anolyte and catholyte were the same as in Example 6 and the cell voltage was 50 volts. The following results were obtained.

TABLE 8

| Hours On Line | Amps | Catholyte Chromate Ion Concentration Initial (mg/l) | Final (mg/l) | Percent SPR |
|---|---|---|---|---|
| 0 | 1 | 260 | — | — |
| 2 | 3.8 | 260 | 70 | 73 |
| 4 | 3.5 | 260 | 75 | 71 |
| 7.58 | 3.1 | 260 | 75 | 71 |

This separator had good chromic acid recovery, but the anolyte level decreased continuously due to the flow of transport water from the anode chamber to the cathode chamber. It thus became necessary to add water to maintain the anolyte level to prevent the chromic acid in the anolyte from crystallizing.

The anionic membranes of Examples 4 and 5 had good initial recovery values but were not stable in the chromic acid solution, and either ruptured, as in the case of "SELEMION" membrane, or became non-conductive, as in the case of "TOSFLEX" membrane. The membranes were also difficult to use because they should be pre-wet and must be kept wet at all times. They are also sensitive to tearing.

Both the "POREX" and "ELRAMIX" diaphragms are porous sheet materials. They are preferably wetted out using a surfactant, but can subsequently be handled and installed in the dry state. The performance of the "POREX" diaphragm deteriorated as the anolyte concentration increased.

The ceramic materials are brittle and special equipment must be used to cut and shape them. Since they are rigid, they are difficult to fit to a cell and special handling is required. Being brittle, they are also relatively easy to break. In addition, they suffered in performance, as indicated in Examples 7 and 8.

The diaphragms of the present invention not only provided good recovery of the chromium (VI) ions, but in addition gave a long life when exposed to the corrosive action of chromic acid. In addition, there was little flow of transport water into the anode chamber with the diaphragm of the present invention, less than about 1% based on the catholyte volume per pass. It will be apparent to those skilled in the art that the diaphragm of the present invention could also be employed in recovering metal from dilute acid solutions of anodizing and chromating processes.

It should also be apparent to those skilled in the art that the present invention could be used for the purification of the plating bath, by passing the plating bath to the electrolytic cell, and then recovering and returning the chromium values, free of $Cr^{+3}$ and impurities, either directly to the electroplating cell, or by way of the stagnant rinse tank.

EXAMPLE 9

This Example relates to the recovery of nickel metal from a spent electroless nickel bath. The same two compartment cell of Example 1 was used. The cell comprised an "ELRAMIX" separator similar to that of Example 1. The separator was compressed at five tons/in$^2$ and had a permeability less than 0.030 mm$^{-1}$Hg at two liters per minute air flow through a 30 in$^2$ area of the separator. The separator was wetted with "ZONYL FSN". The anode was a titanium substrate coated with a precious metal oxide. The anode had the dimensions 4"×3"×¼". The cathode was a reticulated nickel having the dimensions 4"×3"×¼".

Both the catholyte and anolyte chambers contained the same spent nickel solution. The catholyte was recirculated. The cell was operated as follows:

| | |
|---|---|
| Operating time | 3 hours |
| Catholyte vol. | 200 cc's |
| Initial current | 5 amps |
| Final current | 5 amps |
| Initial voltage | 5.5 volts |
| Final voltage | 7 volts |
| Initial catholyte pH | 4.3 |
| Final catholyte pH | 11.1 |
| Initial nickel level in catholyte | 5.9 g/liter |
| Final nickel level in catholyte | 14.5 ppm |
| Current efficiency of nickel metal recovery | 14% |

This Example showed a significant recovery of the nickel in the catholyte, including nickel plating at the cathode.

A comparative test in a single compartment cell (with no separator) under similar conditions showed no plating of nickel at the cathode.

EXAMPLE 10

This Example relates to the recovery of copper and zinc from a sulfuric acid/nitric acid etch bath. The same two compartment cell of Example 9 was used. The cell comprised an "ELRAMIX" separator which was 4"×3"×¼" thick. The separator was compressed at five tons/in$^2$ and had a permeability less than 0.030 mm$^{-1}$Hg at two liters per minute air flow through a 30 in$^2$ area of the separator. The separator was wetted with "ZONYL FSN".

The cathode was a 4"×3"×¼" thick titanium sheet. The anode was a 4"×3"×¼" thick titanium substrate coated with a precious metal oxide.

The catholyte comprised 100 cc's of sulfuric acid having a concentration of 50 grams per liter. The anolyte comprised 350 cc's of a sulfuric acid/nitric acid etching solution. The etching solution was circulated in the anolyte chamber.

The cell was operated as follows:

| | |
|---|---|
| Anolyte/Catholyte temperature | 25° C. |
| Operating time | 1 hour |
| Cell current | 5 amps |
| Cell voltage | 4.5 volts |
| Initial copper level in anolyte | 7.23 gpl |
| Final copper level in anolyte | 6.75 gpl |
| Initial zinc level in anolyte | 1.02 gpl |
| Final zinc level in anolyte | .99 gpl |
| Current efficiency of copper/zinc recovery | 2.7% |

The copper and zinc plated at the cathode. This Example showed good recovery of copper and zinc at the cathode.

EXAMPLE 11

This Example relates to the simultaneous recovery of chromic acid from a chromium electroplating rinse solution and rejuvenation of the chromic acid plating bath.

As is well known to those skilled in the art, chromium, for either hard or decorative chromium plate, is deposited from an electroplating bath containing chromic acid (the hydrate of $CrO_3$), together with sulfate and various other materials. During normal electrodeposition, the deposition is accompanied not only by a decrease in the concentration of hexavalent chromium, but also an increase in the concentration of trivalent chromium ($Cr^{+3}$) in the bath. This build-up of the concentration of trivalent chromium may be due to a higher rate of plating.

As the concentration of trivalent chromium increases, the resistance of the plating bath increases, reducing the throwing power of the bath, and causing pitting and treeing.

This Example shows that the apparatus of FIG. 1, modified as described herein, can desirably be used for rejuvenating the chromic acid plating bath as well as recovering chromic acid from the electroplating rinse solution.

Figure 4:
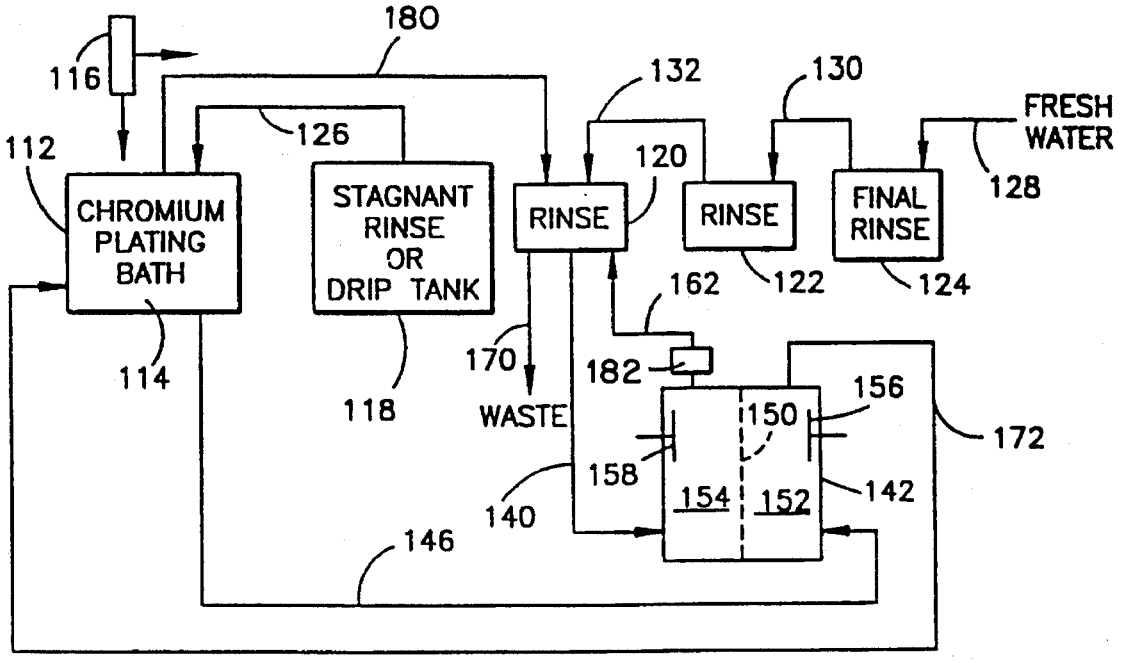
FIG. 4 is a schematic flow diagram of a chromium electroplating process and a rejuvenation/recovery system of the present invention in which chromic acid is recovered from the electroplating process rinse solution, and simultaneously therewith, the chromic acid plating bath is rejuvenated.

The apparatus, of this Example, is shown in FIG. 4. The apparatus is similar in many respects to that of FIGS. 1–3. Components in FIG. 4 similar to components in FIGS. 1–3 are given the same last two digits in the component numbering.

Referring to FIG. 4, an electroplating cell 112 is shown. The cell 112 contains a chromic acid plating bath 114. The apparatus of FIG. 4 may or may not include a stagnant rinse or drip tank 118 and return line 126. The apparatus will have at least one rinse tank. Three rinse tanks 120, 122 and 124 are shown. Fresh water is added in line 128 to the final rinse tank 124, with rinse solution being cascaded, in lines 130 and 132, to the rinse tanks 122 and 120, as in the embodiments of FIGS. 1–3.

In the electroplating process, a part 116 is dipped into the bath 114 and held in the bath 114 for a sufficient period of time to be plated. After plating, the part 116 is moved to or above the stagnant tank 118, if present, and then to the rinse tank 120, and rinse tanks 122 and 124 in succession, if present. As with the embodiment of FIGS. 1–3, most of the chromic acid carried by part 116 from the plating bath 114 is removed from the part 116 in the rinse tank 120, with lesser amounts being removed in the second and third rinse tanks 122, 124. Thus, the rinse tank with the highest concentration of chromic acid is the first rinse tank 120. It is desirable to recover the chromic acid in the rinse solution for reuse in the plating bath 114.

In addition, in the electroplating process, some metals, such as copper, iron, or nickel, which are dissolved in or dragged into the chromic acid bath 114, are carried over with part 116 into the rinse solution. Over a period of time, these metals, herein referred to as impurities, build up in concentration to the point where they have to be removed from the rinse solution.

Still further, as mentioned above, a build-up of trivalent chromium ($Cr^{+3}$) occurs in the plating bath 114, as well as impurities such as copper, iron and nickel, depending upon the composition of parts 116. This is accompanied by a decrease in hexavalent chromium ions ($Cr^{+6}$). The plating bath 114 thus has to be rejuvenated for continued use.

As with the apparatus of FIGS. 1–3, an electrolytic cell 142 is provided. The cell 142 has an anode chamber 152, containing an anode 156, and a cathode chamber 154, containing a cathode 158. The anode chamber 152 and the cathode chamber 154 are separated from each other by an ion permeable separator 150. A preferred separator is a fibrous mat diaphragm, preferably an "ELRAMIX" separator as disclosed herein. However, in the aspect of the invention as illustrated in this example other types of diaphragms can be used to serve as ion permeable separators, as well as using a membrane.

As with the embodiment of FIGS. 1–3, it will be understood by those skilled in the art that the electrolytic cell 142 can comprise multiple anode chambers 152, multiple cathode chambers 154, and multiple separators 150.

Referring again to FIG. 4, the rinse tank 120 is connected by line 140 to the cathode chamber 154. A return line 162 leads from the cathode chamber 154 back to the rinse tank 120. The return line 162 passes through a clarifier 182. The purpose of lines 140 and 162 is to provide a means for treating the rinse solution from rinse tank 120 in the cathode chamber 154, as with the embodiment of FIGS. 1–3. A line or the lines 140 and 162 can be connected in ways other than as shown in FIG. 4, for instance to rinse tanks 122, 124. Regardless, the solution to be treated in the cathode chamber 154 hereinafter is referred to as the catholyte/rinse.

The electroplating cell 112 is connected with the electrolytic cell 142 by means of a line 146 which leads to the anode chamber 152, and a return line 172 which leads back to the electroplating cell 112. The solution to be treated in the anode compartment is hereinafter referred to as the anolyte/bath.

It will be understood that all of the lines 140, 162, 146 and 172 will have a pump or other such means for maintaining circulation of the respective solutions.

The following test illustrates operation of the apparatus of FIG. 4. The purpose of the test was to determine the oxidation rate of trivalent to hexavalent chromium and removal rate of metal impurities.

A test electrolytic cell 142 had two compartments, a cathode compartment 154, and an anode compartment 152. Each compartment had a cross-sectional area of 60 square inches. The cathode 158 was a titanium mesh having a 12 inch by 5 inch active area. The anode 152 was a lead/7% tin anode, one-quarter inch thick, having an active area of 10 inches by 5 inches. The separator 150 was an "ELRAMIX" diaphragm having a base weight of 5 kilograms per square meter, pressed at 5 tons per square inch.

The test was conducted for a period of eight hours, with recirculation of both the anolyte/bath and catholyte/rinse. The catholyte/rinse was circulated through a coil tubing located in a cooling bath (all not shown) to maintain the temperature of the catholyte/rinse at 25°–40° C. The amount of catholyte/rinse that was recirculated was four liters. The catholyte/rinse was a pure chromic acid solution having at 0 hours a chromic acid concentration ($CrO_3$) of 50 grams/liter. The initial pH of the catholyte rinse was 1.7.

The anolyte/bath was a contaminated chrome plating solution. The solution had, at 0 hours, the following impurities, all basis four liters of anolyte:

| Element | Grams/Total |
|---|---|
| Cu | 20.6 |
| Zn | 7.8 |
| Ni | 14.6 |
| Ca | 6.4 |
| Fe | 1.36 |

The calcium ions in the anolyte/bath were probably present from normal water hardness. It will be understood that other alkali metal or alkaline earth metal ions can be present, depending upon the water source, as well as other metal ions, such as aluminum, depending upon the substrate being plated or treated. The anolyte/bath also contained 194 grams/liter of hexavalent chromium and also trivalent chromium. The amount of trivalent chromium is calculated when the total chrome is determined by ICP and the hexavalent chromium is determined by titration.

During operation of the electrolytic cell, hexavalent chromium ions in the catholyte/rinse migrated through the separator 150 into the anolyte/bath, enriching the anolyte/bath in hexavalent chromium ions. Simultaneously, trivalent chromium ions in the anolyte/bath were oxidized to hexavalent chromium ($Cr^{+6}$) further enriching the anolyte/bath in hexavalent chromium. Impurities such as copper, zinc, nickel, calcium and iron in the anolyte/bath migrated through the separator 150 into the catholyte/rinse. Thus, the anolyte/bath solution was reduced in these impurities. This, plus the enrichment of the anolyte/bath in hexavalent chromium rejuvenated the anolyte/bath, for reuse in the electroplating cell.

Specifically, the anolyte/bath, at the end of the test, at eight (8) hours, had the following impurities, all basis 3.7 liters of anolyte:

| Element | Grams/Total |
|---|---|
| Cu | 15.7 |
| Zn | 5.37 |
| Ni | 10.73 |
| Ca | 4.4 |
| Fe | 1.15 |

It can be seen that the concentration of these metals desirably decreased, in the anolyte/bath, during the test period. The chromic acid concentration ($CrO_3$) in the anolyte/bath increased from 194 grams/liter to 273 grams/liter. The chromic acid concentration ($CrO_3$) in the catholyte/rinse decreased from 50 grams/liter to 0.4 grams/liter. From these values, it was determined that a total of 50.25 grams/liter of chromic acid ($CrO_3$) was recovered in the anolyte/bath, of which 18.8 grams was calculated to be trivalent chromium ($Cr^{+3}$) oxidized to hexavalent chromium ($Cr^{+6}$) at the anode.

The metal ions which migrated to the catholyte rinse solution were precipitated in the cathode chamber and then were filtered from the catholyte/rinse. The pH of the catholyte/rinse, during the eight hour test, increased to 10.5.

The following Table 10 gives cell conditions under which the cell was operated, during the eight hour test:

TABLE 10

| Hour | Cell Amperage | Cell Voltage |
|---|---|---|
| 0 | 45 | 10 |
| 1 | 45 | 10 |
| 2 | 40 | 10 |
| 3 | 38 | 10 |
| 4 | 50 | 35 |
| 5 | 50 | 43 |
| 6 | 30 | 43 |
| 7 | 10 | 43 |
| 8 | 5 | 43 |

It can be seen from the above Table that as the chromic acid concentration in the catholyte/rinse dropped, and as the pH increased from the initial pH of 1.7 to the final pH of 10.5, the cell voltage had to be substantially increased to maintain cell efficiency. Even with an increased cell voltage, current dropped to 5 amps in the eighth hour. It has since been determined that although the rinse solution can have a pH generally in the range of 2–7, to optimize operation of the cell, for the objectives listed, the pH of the catholyte/rinse is best maintained in the range of about 5–7, for both recovery of chromium values and elimination of impurities, e.g., tramp metal ions from the anolyte/bath. This can be accomplished by providing a bleed line 180, FIG. 4, from the chromium plating bath 114 to the rinse tank 120. Alternatively, sufficient chromic acid may pass with parts 116 to the rinse tank 120, during operation of the cell 142 in conjunction with the bath 114, to maintain-the catholyte/rinse at the needed pH level.

In the above test, the focus was on the dual objectives of (i) rejuvenating the anolyte/bath in terms of oxidation of the $Cr^{+3}$ to $Cr^{+6}$ and ridding the anolyte of the tramp metal ions, and (ii) recovering hexavalent chromium ions from the catholyte/rinse solution.

An advantage of the present invention is that the apparatus of FIG. 4 can be tailored to the requirements of a particular plating or anodizing process, primarily by adjusting the pH to a desired value and then maintaining it at that value. For instance, if the focus is on ridding the anolyte/bath of impurities, because of a high degree of dissolution or drag-in of impurities from the base metal, a high pH may be desired, on the order of 5–7 as in the above test. A high pH results in better precipitation of the impurities in the catholyte/rinse. This pH normally is possible by simply using less bleed from the plating bath 114, in line 180.

However, if the focus is on the recovery of hexavalent chromium ions, and impurities are not a problem, a lower pH of the catholyte/rinse solution is desired. Preferably, the pH in the cathode compartment is maintained at about 2–3. At this pH, a minimum power input is required. A lower pH also increases cell current and trivalent chromium oxidation rate. Reducing the pH in the catholyte/rinse solution can be accomplished by increasing the bleed of chromic acid in line 180 from the plating bath 114 to the rinse tank 120.

When optimization of both precipitation of metal impurities and oxidation of trivalent chromium is desired, the pH may be maintained at about 3–5.

Accordingly, it can be seen that the apparatus of this Example, in addition to providing a means for simultaneous recovery of hexavalent chromium from a rinse solution and rejuvenation of the plating bath, offers a means by which, with few adjustments, the apparatus can be modified to the particular requirements of one plater or another. The present invention in this respect offers a design flexibility with a single piece of apparatus which has heretofore not been available in the prior art.

Whereas the apparatus of FIG. 4 has been described with respect to treatment of a chromium plating bath, it will be seen by those skilled in the art that the apparatus is also useful for treating an anodizing bath. The anodizing solution can be a chromic acid solution or a sulfuric acid solution. The principles of FIG. 4 can also be useful in connection with an etch bath, including a plastic etch bath.

Figure 5:
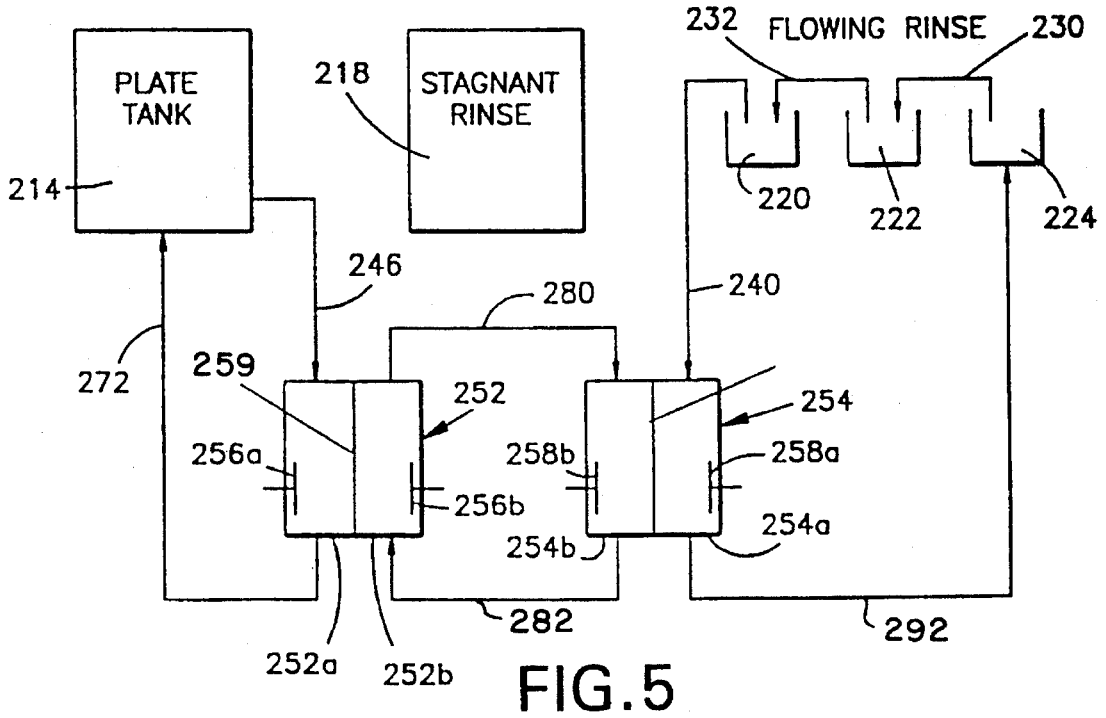
FIG. 5 is an embodiment of the system of FIG. 4.

Referring still to the drawings, reference is now made to FIG. 5 which is an embodiment of the apparatus of FIG. 4. Referring to FIG. 5, a first electrolytic cell 252 is associated with the plating bath 214, and a second electrolytic cell 254 is associated with the first rinse tank 220. The first cell 252 has an anode chamber **252*a*, an anode 256*a* therein, cathode chamber 252*b*, and a cathode 256*b* therein. The anode chamber 252*a* and cathode chamber 252*b* are separated by a separator 259. Anolyte/bath from bath 214 is circulated through the anode chamber 252*a* in lines 246 and 272. The second cell 254 has a cathode chamber 254*a*, a cathode 258*a*** therein, an anode chamber 254*b*, and an anode 258*b* therein. The anode chamber 254*b* and cathode chamber 254*a* are separated by a separator 255. Catholyte/rinse is circulated in lines 240 and 292 through the cathode chamber 254*a*. Lines 280 and 282 circulate the catholyte of the first cell cathode chamber 252*b*, providing a connected loop, preferably a closed loop, to the anode chamber 254*b*, of the second cell, and the anolyte, of the second cell, to the cathode chamber 252*b*, of the first cell. In the aspect of the invention illustrated in this figure, the separators 255 and 259 may be ion permeable separators, including ceramic separators, as well as membranes, although fibrous mat diaphragms are preferred in each instance.

In essence, this embodiment provides a two-stage recovery of chromic acid from the catholyte/rinse to the anolyte/bath, and a two-stage migration of tramp metal ions from the anolyte/bath to the catholyte/rinse. Concerning the former, the catholyte/rinse may, by way of example, have a concentration of chromate ions of about 200–500 ppm. The chromate ions migrate, in cell 254, to anode chamber 254*b* and enter the loop defined by chamber 254*b*, cell chamber 252*b*, and lines 280, 282. The concentration of chromate ions in the loop can be, by way of example, 1–5 grams/liter. The chromate ions in the loop then migrate in cell 252 into the anolyte/bath in anode chamber 252*a*. Concerning the tramp metal ions, these also transfer in two stages. In cell 252, the tramp metal ions enter the loop defined by chambers 252*b*, 254*b* and lines 280, 282, and then migrate in cell 254, into the catholyte/rinse.

The present invention offers several advantages. First, the precipitation of the tramp metal ions is dependent upon pH. The precipitation takes place in cell 254, not in the loop defined by chambers 252*b*, 254*b* and lines 280, 282. Thus, the medium in the loop can be maintained at a low pH, e.g., within the range of from about 2 to below 7 and more typically of 3–5. This favors driving the chromate ions from the loop into the anolyte bath in chamber 252*a*, which already has a high concentration of chromate ions. Specifically, because the catholyte and anolyte in cell 252 both have a low pH, a high current flow at a given voltage is possible. The transfer of chromate ions in cell 252 to the anolyte/bath can thus be carried out at a high efficiency.

Since it is not necessary to maintain a low pH in the cathode chamber 254*a* of cell 254, the catholyte/rinse can readily be returned to the last rinse bath 224. This eliminates the need for a separate clarifier (such as 180 in FIG. 4), since the precipitated metals can then be removed from the catholyte/rinse using existing waste treatment facilities in many plating operations.

It is also contemplated that the first and second cells 252, 254 can be replaced by a three compartment cell having an anode chamber 252*a*, cathode chamber 254*a*, and a center compartment therebetween. This center compartment can operate in the manner of the loop, with liquid circulation to and from the compartment occurring at the separators 255, 259. Alternatively, liquid can be withdrawn from the center compartment, as at the bottom of the compartment, recirculated and fed back to the top of the compartment. Such liquid recirculation can enhance center compartment mixing.

From the above description of the invention, those skilled in the art will perceive improvements, changes and modifications. Such improvements, changes and modifications within the skill of the art are intended to be covered by the appended claims.

Having described the invention, the following is claimed:

1. A method of making a diaphragm comprising:

preparing a slurry comprising organic halocarbon polymer fibers along with finely divided inorganic particulates, the ratio of polymer fibers to inorganic particulates comprising 5–70 weight percent polymer fibers to 30–95 weight percent inorganic particulate;

forming a mat of said fibers plus particulates having a thickness in the range of 0.03–3 centimeters and a weight per unit of surface area of about 3–12 kilograms per square meter;

heating said mat of fibers plus particulates at a temperature in the range of 300°–390° C. effective to fuse said fibers together;

compressing the mat of fused fibers plus particulates at a pressure in the range of about one to ten tons per square inch, said compressed mat having a permeability less than 0.03 $mm^{-1}Hg$ at two liters per minute air flow through a 30 inch square area of the mat.

2. The method of claim 1, wherein said diaphragm is a non-isotropic fibrous mat having a weight per unit of surface area of about 3–7 kilograms per square meter.

3. The method of claim 2, wherein said diaphragm has a permeability in the range of 0.015–0.01 $mm^{-1}Hg$ at two liters per minute air flow through a 30 inch square area of the diaphragm and comprises a fibrous mat of said polymer fiber with said particulates impacted into said fiber during fiber formation.

4. The method of claim 3 wherein said heating and compressing are concurrently achieved, at least part, by hot pressing.

5. An electrolytic cell having a compressed mat diaphragm of fused fibers plus particulates prepared by the method of claim 1.

6. The cell of claim 5 for the electrolytic treatment of an acid solution.

7. The cell of claim 5 for electrolytic treatment of an alkaline solution.

* * * * *